US007452447B2

(12) United States Patent
Duan et al.

(10) Patent No.: US 7,452,447 B2
(45) Date of Patent: Nov. 18, 2008

(54) STEAM DISTRIBUTOR FOR STEAM SHOWERS

(75) Inventors: Shizhong Duan, Coquitlam (CA); Geoffrey Arthur Jones, Bowen Island (CA)

(73) Assignee: ABB Ltd., Dublin (IE)

( * ) Notice: Subject to any disclaimer, the term of this patent is extended or adjusted under 35 U.S.C. 154(b) by 926 days.

(21) Appl. No.: 10/755,216

(22) Filed: Jan. 12, 2004

(65) Prior Publication Data

US 2004/0168784 A1 Sep. 2, 2004

Related U.S. Application Data

(60) Provisional application No. 60/447,518, filed on Feb. 14, 2003.

(51) Int. Cl.
*D21F 1/32* (2006.01)

(52) U.S. Cl. ..... 162/275; 209/380

(58) Field of Classification Search ..... 162/275; 209/380

See application file for complete search history.

(56) References Cited

FOREIGN PATENT DOCUMENTS

| | | |
|---|---|---|
| EP | 1 081 278 A2 | 3/2001 |
| EP | 1 143 067 A2 | 10/2001 |
| FR | 2 462 514 | 2/1981 |

*Primary Examiner*—Mark Halpern
(74) *Attorney, Agent, or Firm*—Paul R. Katterle

(57) ABSTRACT

A steam distributor that uses a porous metal plate to replace the conventional screen plate of a steam shower for distributing steam to a moving web such as the web of a paper making machine. Steam showers using a steam distributor with this porous metal plate can deliver extremely uniform steam to the surface of a paper web. Profiling steam showers constructed by using an array of the steam distributors are able to deliver the best profiling results for various paper products. The porous metal plate can be considered as an equivalent of a screen plate with thousands of micro-orifices arranged tightly in both the machine direction and the CD direction.

24 Claims, 3 Drawing Sheets

STEAM DISTRIBUTOR FOR STEAM SHOWERS

CROSS REFERENCE TO RELATED APPLICATION

This application claims the priority of U.S. provisional patent application Ser. No. 60/447,518 filed on Feb. 14, 2003, entitled "Steam Distributor For Steam Showers" the contents of which are relied upon and incorporated herein by reference in their entirety, and the benefit of priority under 35 U.S.C. 119(e) is hereby claimed.

1. Field of the Invention

This invention relates to efficiently distributing steam to a web of a paper machine, and more specifically, to a steam distributor that can be used in steam showers to deliver steam with a predetermined mass profile.

2. Description of the Prior Art

Steam showers are widely used in a papermaking machine for production gain and quality control. FIG. 1 shows a papermaking machine and four possible mounting locations for the steam showers. Steam is usually added before the press nips to increase the production with the effect of increasing the temperature of all of the moisture in the web. The added temperature makes the water removal by pressing much more effective. The moisture removed by pressing is much greater than the added moisture resulting from steam condensation. The web leaves the press nips and enters the dryer. A web with higher dryness at the end of pressing allows the dryer to run at a higher speed and hence results in increased paper production.

Steam is also added by using profiling steam showers to improve the paper quality such as moisture distribution across the paper. Profiling steam showers work by selectively delivering steam to segments (or zones) of the web in the cross-machine (CD) direction to compensate an unfavorable moisture distribution in that direction.

It is well known that there are numerous influences on the paper machine that can cause a variation of the moisture content, especially in the CD direction. Wet edges and characteristic moisture profiles are common occurrences on paper machines. Profiling steam showers are also used for finishing purposes on calenders or supercalenders to improve paper smoothness, gloss and caliper etc.

Existing profiling steam showers are constructed with an array of steam distributors along the CD direction. A single steam distributor is also used for non-profiling applications that delivers a constant pattern of steam across the CD direction. The steam distributor usually consists of a screen plate that is mounted nearby and facing the surface of the web to be steam treated. Traditionally, the screen plate has a number of orifices with a constant spacing along the CD direction through which steam impinges upon the moving web. The amount of steam passing through each steam distributor is adjustable by changing the steam pressure feeding the screen plate. Positioning or regulator-type actuator valves controlled by pneumatic signals generated remotely off the machine are usually employed to manipulate the steam pressure within each steam distributor for profiling purpose.

Uniformly distributing steam across the web of paper in a paper machine requires the steam distributing screen plate of a steam shower to have enough small orifices arranged tightly along the cross-machine (CD) direction.

This is especially true for steam shower applications in the dryer end or finishing calendering where steam flow is very small. A wavy moisture profile in the CD direction of the paper resulting from steam treatment using conventional screen plates is a common phenomenon.

There are two very important parameters for profiling steam showers. One of the parameters is the mass (moisture or heat) distribution within a single zone and the other is the coupling between adjacent zones. Ideally, a flat moisture profile at reel could be achieved if the mass distribution is a perfect square in shape within a single zone and the coupling is zero between neighboring zones, as long as the zone size is small enough. As is well known, the velocity profile and the mass profile of a single orifice jet both have a bell-shaped distribution. A single steam distributor consisting of a number of such orifices produces a wavy mass profile on the surface of the sheet. There is also a substantial coupling between adjacent distributors similar to the coupling between neighboring jets.

The magnitude of the fluctuation of the mass distribution is a function of several parameters including single jet mass distribution, orifice spacing and the distance between the orifices and the paper surface. Theoretically the smaller the orifice spacing the flatter the resulting mass profile, and the less the coupling between adjacent zones as a result of reduced sheet distance. However, smaller orifice spacing results in more orifices required in a single zone as well as smaller orifice diameter to maintain the flow rate and consequently higher cost for the screen plate, and the steam distributor or the steam shower.

To overcome the shortcomings of conventional steam showers, a new steam distributing method and apparatus is disclosed. The steam distributor of the present invention consists of a steam distributing plate made from porous metal. The width of the porous metal plate represents the zone size of the steam shower in the CD direction. The steam flow rate passing through a single porous metal plate with a fixed zone size is determined by the media grade of the porous metal, the thickness and the length in the machine direction of the plate as well as the steam pressure feeding the porous metal plate.

The porous metal plate is typically manufactured by preparing metal powders with a precisely controlled particle size based on the media grades produced. Powders with constant particle size are then compressed into a plate before being sintered. This procedure produces porous metal plates with uniform porosity and required bonds between the particles. The low cost and ready availability of the porous metal plates with different media grades make the steam distributor of the present invention practical yet affordable.

SUMMARY OF THE INVENTION

A steam distributor for use with a machine that produces a web. The steam distributor comprises a steam housing having a steam inlet in sealed communication with the housing; and one or more porous metal plates mounted in the housing in an orientation to face the web when the steam distributor is mounted at a predetermined location on the web producing machine, each of the one or more porous metal plates having a plurality of steam outlets which are in sealed communication with the steam housing.

An apparatus for distributing a fluid for use with a machine that produces a web. The apparatus comprises a housing for the fluid having a fluid inlet in sealed communication with the housing; and one or more porous metal plates mounted in the housing in an orientation to face the web when the fluid distributing apparatus is mounted at a predetermined location on the web producing machine, each of the one or more porous metal plates having a plurality of fluid outlets which are in sealed communication with the housing.

A steam shower for use with a machine that produces a web. The steam shower comprises two or more steam housings, each of the two or more steam housings separated from an adjacent one of the two or more housings and having a steam inlet in sealed communication with an associated one of the two or more housings; and one or more porous metal plates mounted in the housing in an orientation to face the web when the steam shower is mounted at a predetermined location on the web producing machine, each of the one or more porous metal plates having a plurality of steam outlets which are in sealed communication with an associated one of the two or more steam housings.

In combination a machine for producing a web and one or more fluid distributors each mounted at an associated one of one or more predetermined locations along the web producing machine, each of the one or more fluid distributors comprising:

a fluid housing having a fluid inlet in sealed communication with the housing; and one or more porous metal plates mounted in the housing in an orientation to face the web when each of the one or more fluid distributors is mounted at the associated one of the one or more predetermined locations, each of the one or more porous metal plates having a plurality of fluid outlets which are in sealed communication with the fluid housing.

In combination a machine for producing a web and one or more steam showers each mounted at an associated one of one or more predetermined locations along the web producing machine, each of the one or more steam showers comprising:

two or more steam housings, each of the two or more steam housings separated from an adjacent one of the two or more housings and having a steam inlet in sealed communication with an associated one of the two or more housings; and one or more porous metal plates mounted in the housing in an orientation to face the web when each of the one or more steam showers is mounted at the associated one of the one or more predetermined locations, each of the one or more porous metal plates having a plurality of steam outlets which are in sealed communication with an associated one of the two or more steam housings.

DESCRIPTION OF THE PREFERRED EMBODIMENT(S)

Figure 2:
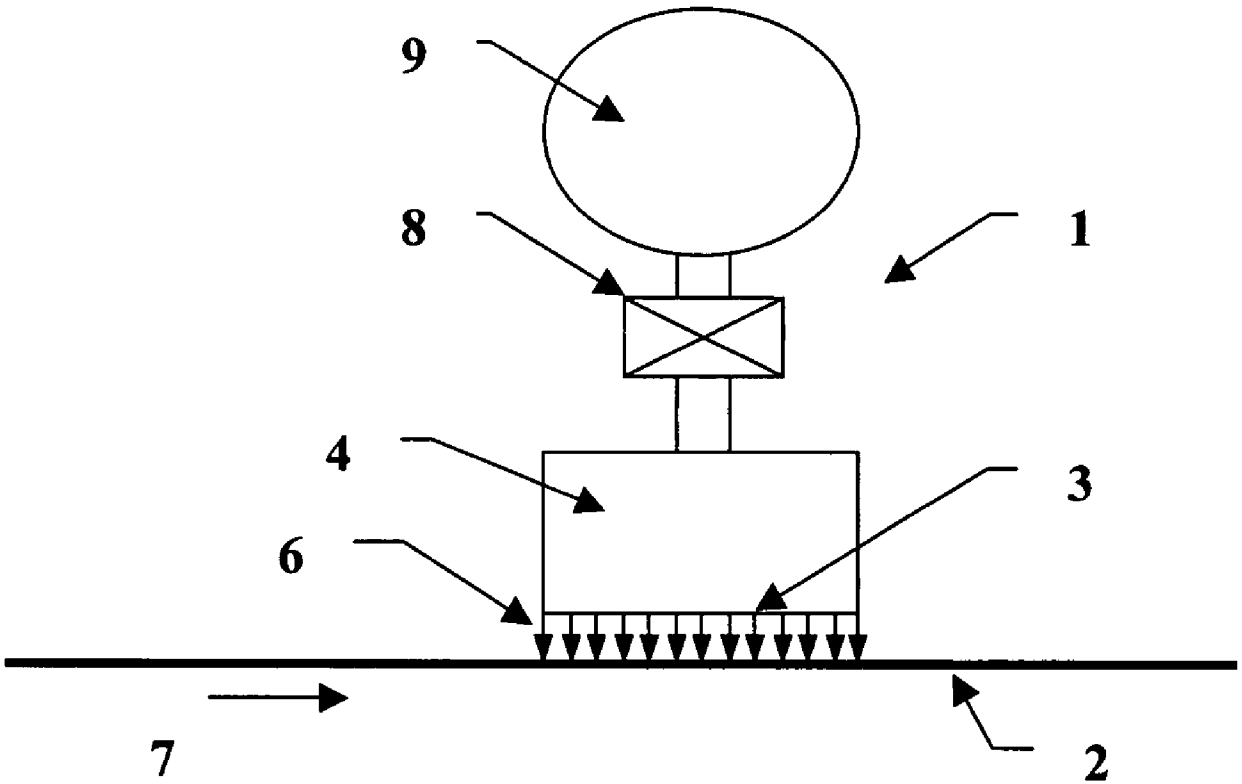
FIG. 2 shows a schematic section view through an embodiment of the steam distributor of the present invention that can be used in steam showers.

Referring now to FIG. 2, there is shown a schematic section view through an embodiment of the steam distributor 1 according to the present invention for delivering steam to the web 2 of a papermaking machine. The steam distributor 1 is mounted close to the paper web 2 that is to be steam treated by supports (not shown). The arrow 7 shows the machine direction (MD), that is, the moving direction of the web 2.

The steam distributor 1 comprises a steam housing 4 and a steam inlet 9 that is in sealed communication with the steam housing 4. One or several pieces of porous metal plates 3 facing the web 2 at the bottom of the steam distributor 1 form the steam outlets of the housing 4. The steam outlets on the porous metal plate 3 are also in sealed communication with the steam housing 4. Preferably, the porous metal plate 3 is placed parallel to the web of the paper sheet. The porous metal plate 3 is flat if the steam distributor 1 is mounted above a flat web. The porous metal plate 3 can also be formed into a curved metal sheet to match the curvature of the web 2 if the steam distributor 1 is mounted to face a roll. Arrow 6 shows the straight streamlines of the steam flow passing through the porous metal plate 3.

The width of the porous plate 3 in the cross-machine direction defines a band on the web surface that is affected by the steam. This band could cover the whole web surface if a non-profiling steam shower is to be used. In the case of profiling steam showers, the width of the band in the CD direction defines the zone size.

The size of a single zone can be arbitrary, however 2 inches (about 5 cm) to 6 inches (about 15 cm) are typical for existing profiling steam showers.

Figure 1:
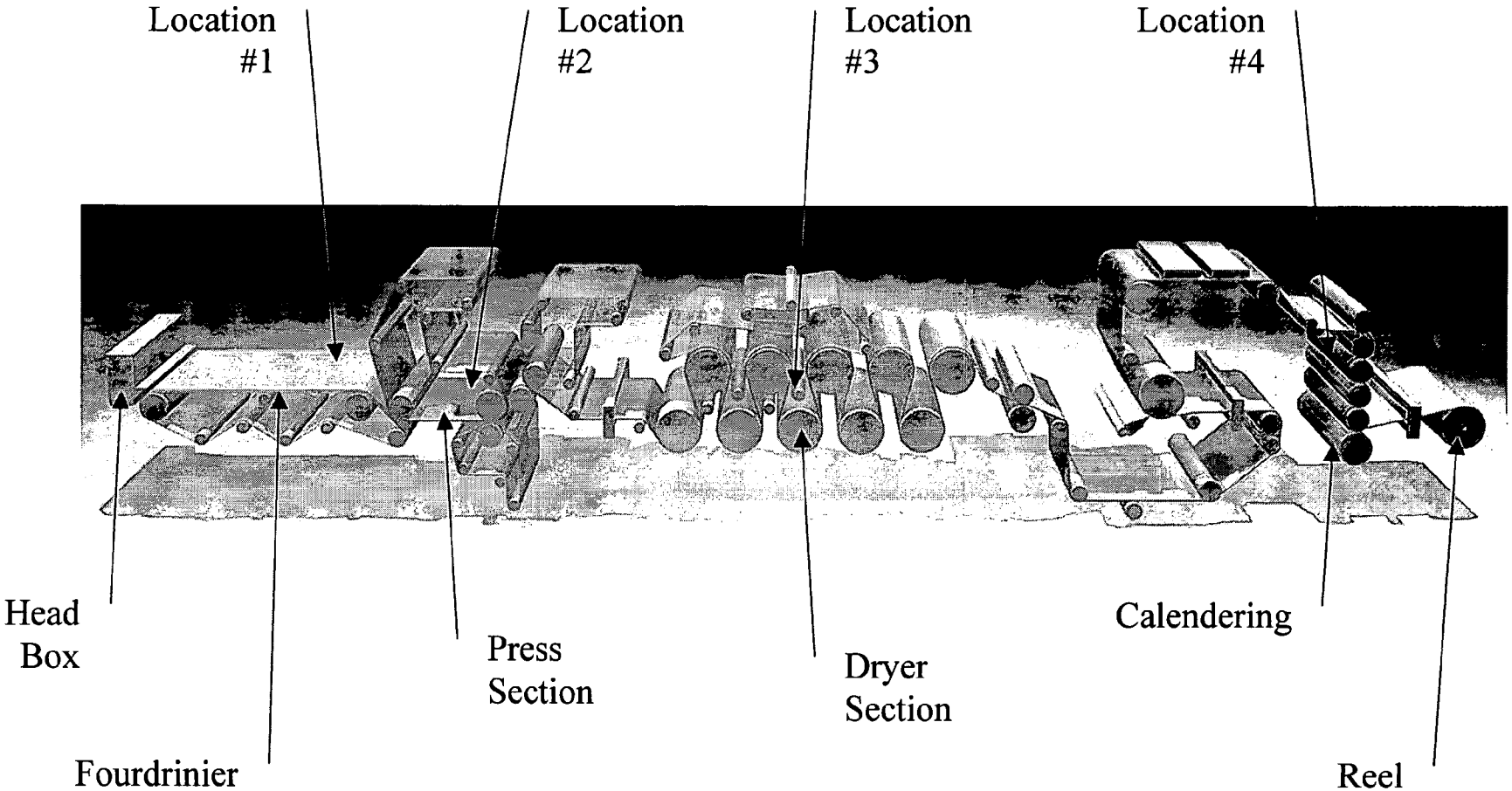
FIG. 1 shows a schematic for a papermaking machine and four well known locations for the steam showers of the present invention.

For a steam distributor 1 with a fixed width of the porous metal plate 3, the steam flow rate passing through the steam distributor 1 is determined by several properties of the porous plate 3 as well as the steam pressure in the steam housing 4. The influencing properties of the porous metal plate 3 include the length of the porous plate 3 in the machine direction, the media grade and the thickness of the porous plate 3. The variety in the selection of the porous metal plate 3 allows the users of the steam distributor 1 to design a steam shower that gives the best fit to their specific application. The application could be in the wet end (Location #1 and #2 in FIG. 1) or in the dry end (Location #3 in FIG. 1, for example), or even in a finishing calender (Location #4 in FIG. 1) of a paper making machine.

After being mounted on the paper machine, the steam distributor 1 can deliver controllable steam flow to the web 2 by manipulating the steam pressure in the steam housing 4. An actuator valve 8 located between the inlet 9 and the steam housing 4 can be used to provide the required steam pressure in the steam housing 4. The inlet 9 is in sealed communication with a pressurized steam source (not shown) that is located off the paper-machine and readily available in any paper mill. The web 2 will receive no steam from the steam distributor 1 if the steam pressure in the steam housing 4 is zero. Increasing the steam pressure inside the housing 4 increases the steam flow passing through the porous metal plate 3 and consequently increases the amount of steam received by the moving web 2.

One benefit of the steam distributor 1 is that it delivers steam with extreme uniformity. The porous metal plate 3 can be considered as a conventional screen plate having thousands of thousands of micro-orifices aligned in both the cross-machine direction and the machine direction with spacing in the range of microns. The result is a flat mass or moisture or heat profile within the span (or zone) of the steam distributor. The flat steam distribution of the steam distributor 1 benefits all steam shower applications.

Another benefit of the steam distributor 1 is the minimum coupling between neighboring distributors of a steam shower. The minimum coupling is a direct result of the almost perfect square-shaped steam mass profile generated by a single steam distributor 1. The result is the highest resolution achievable by a steam shower with a fixed zone size.

Yet another benefit associated with the minimum coupling of the steam distributor 1 is the insensitivity of the steam distributor's distance to the web or sheet 2. Sheet distance is a sensitive parameter for conventional steam showers that require time-consuming on machine fine-tuning at start up. Inappropriate sheet distance of conventional steam showers causes streaking on the surface of the paper. The collimated beams of steam delivered by the steam distributor 1 can potentially eliminate the streaking without fine-tuning the sheet distance.

Yet another benefit of the steam distributor 1 is its increased controllability. The pressure drops through a conventional screen plate are less than a couple of PSI in unit. Increased pressure drop in the conventional screen plate results in excessive steam velocity and consequently over-spray of the steam. The porous metal plate 3 of the steam distributor 1 allows the pressure drop to be much larger than that through a conventional screen plate thanks to the added frictions through the micro orifices in the porous plate 3. The efficient mixing between environment air and micro steam jets at the porous metal plate 3 during the distribution of the steam may also benefit the increased pressure drop. Larger pressure drops in steam distributor 1 provide a wider control range, as the flow rate passing through the steam distributor 1 is regulated by adjusting the pressure feeding the screen plate or the porous metal plate 3.

The steam distributor 1 is not limited to the configuration of one porous metal plate 3 per distributor. It is possible to construct a steam shower with steam distributing zones that share a single piece of porous metal plate across the CD direction.

Figure 3:
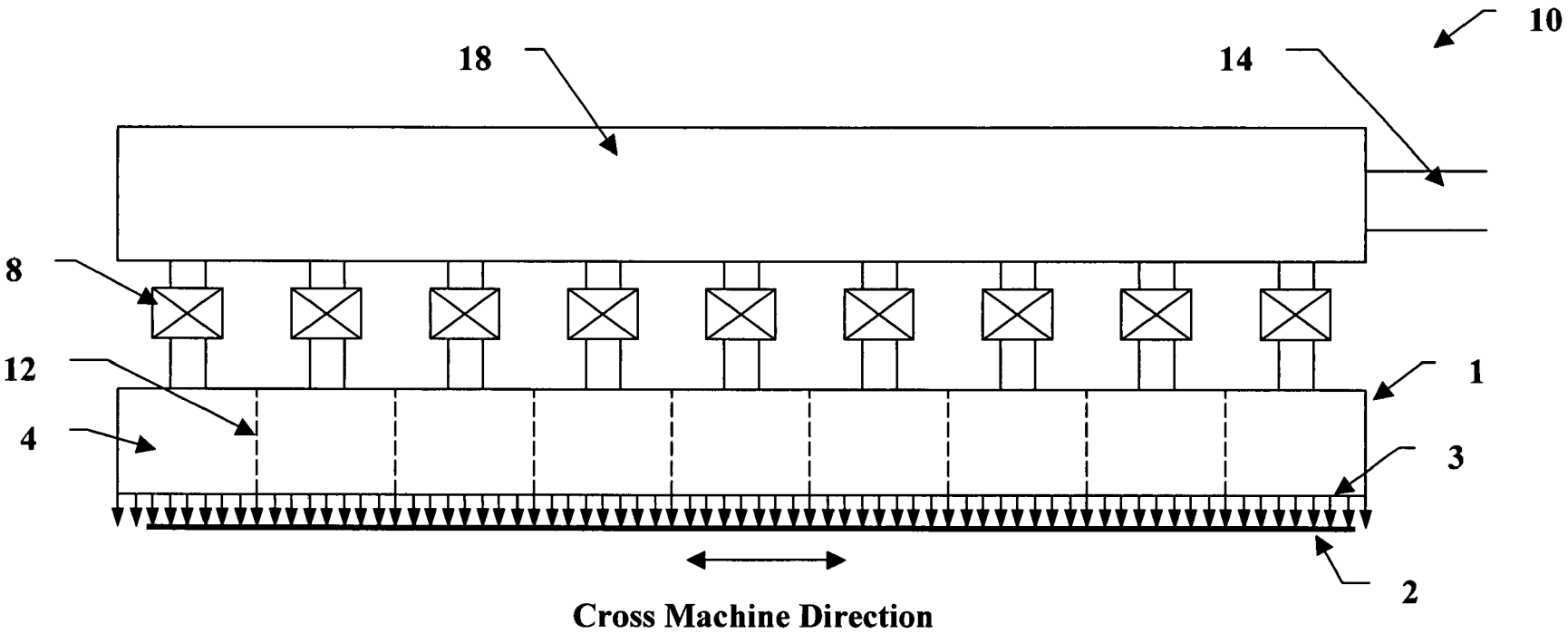
FIG. 3 shows a schematic view of an embodiment of the steam shower of the present invention.

FIG. 3 shows a schematic steam shower 10 that is consisting of an array of the steam distributor 1 of the present invention across the machine direction. The steam housings 4 are separated by metal plate 12. Each steam distributor 1 has an actuator valve 8 that controls the steam pressure in the corresponding steam housing 4. All the steam distributors 1 share a common steam chamber 18, which is in sealed communication with a steam inlet 14. The steam inlet 14 is in sealed communication with a steam source (not shown) off the machine.

Pressurized steam from the steam source flows into the common chamber 18 through the inlet 14. Based on the measured profile near the reel, steam actuators 8 manipulate the steam pressure in each individual steam housing 4, such that the steam flow through each steam distributor 1 is exactly the required amount to achieve a flat profile at the reel.

The porous metal plate 3 in FIG. 3 can be one single piece across the whole steam shower 10 to reduce the manufacturing and maintenance costs. In this case, sealing between adjacent steam housing 4 may be necessary.

A porous metal plate 3 in FIG. 3 with shapes other than a rectangle could be used to produce a desired mass profile in the CD direction. A single steam distributor 1 as shown in FIG. 2 with a porous metal plate 3 cut into a special contour along the CD direction according to a measured profile of a selected paper property to be controlled could be used for profiling purposes. The measured profile can be a moisture profile, a gloss profile or any other profile that affects the quality of the paper products in the cross-machine direction. In this case, zone actuators and the conventional on-machine profiling are unnecessary. More importantly, a perfect flat moisture profile at the reel could be achieved as this custom designed steam distributor has infinite resolution. A variety of other arrangements can be devised which would operate on the same principles disclosed above.

It will be clear to a person skilled in the art that the steam distributor and the steam shower using the porous metal plate 3 are useful in many other applications. The present invention is appropriate where the need exists for a tailorable distribution of a fluid (steam, gas or liquid) to a surface of a medium. The distribution could be extremely uniform, or follow a predetermined profile as required.

Another potential use of the porous metal plate using the embodiment of FIG. 2 is a paper suspension device that supports the moving paper web without even touching the surface of the paper. This is especially useful for coated paper. As can be appreciated when the embodiment of FIG. 2 is used for a paper suspension device, element 9 is an inlet for compressed air. Air delivered through the porous metal plate forms a pressurized air cushion between the porous metal plate and the moving web. The air cushion serves as a medium for the contactless support to the moving web.

Yet another potential application of the porous metal plate using the embodiment of FIG. 2 is a highly efficient air curtain or air knife. Air curtains or air knifes are now widely used with water spray systems in papermaking machine to confine the spraying water droplets to the defined rewet area without causing problems to the papermaking process. Air curtains made of porous metal plates can be mounted very close to the moving web without interference to the process. Because the gap between the porous plates and the web sheet can be very small, the air that is required to curtain off water droplets is substantially reduced. By using a porous metal air curtain, it is possible to retain water droplets within the defined rewet area with sufficiently less air consumption. As can be appreciated when the embodiment of FIG. 2 is used for an air curtain or air knife, element 9 is an inlet for compressed air.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by any appended claims.

What is claimed is:

1. A steam distributor for use with a machine that produces a web comprising:

a steam housing having a steam inlet; and one or more porous metal plates mounted in said steam housing in an orientation to face said web when said steam distributor is mounted at a predetermined location on said web producing machine, each of said one or more porous metal plates being formed from metal powder that is sintered such that each of said one or more porous metal plates comprises micro orifices.

2. The steam distributor of claim 1 wherein said one or more porous metal plates are oriented to be parallel to said web when said steam distributor is mounted on said web producing machine.

3. The steam distributor of claim 1 wherein each of said one or more porous metal plates have a profile that matches the profile of said web at said predetermined location where said steam distributor is to be mounted on said web producing machine.

4. The steam distributor of claim 1 wherein each of said one or more porous metal plates are rectangular in shape.

5. The steam distributor of claim 1 wherein each of said one or more porous metal plates are cut into a contour along the cross direction of a web producing machine on which said steam distributor is mounted according to a measured profile of a selected controlling property of said web at said predetermined mounting location.

6. The steam distributor of claim 1 further comprising an actuator valve connected between said housing steam inlet and a source of steam.

7. The steam distributor of claim 6 further comprising a steam inlet connected between said actuator valve and said steam source when said steam distributor is mounted on said web producing machine.

8. An apparatus for distributing a fluid for use with a machine that produces a web comprising:

a fluid housing having a fluid inlet; and one or more porous metal plates mounted in said fluid housing in an orientation to face said web when said fluid distributing apparatus is mounted at a predetermined location on said web producing machine, each of said one or more porous metal plates being formed from metal powder that is sintered such that each of said one or more porous metal plates comprises micro orifices.

9. The apparatus of claim 8 wherein said one or more porous metal plates are oriented to be parallel to said web when said apparatus is mounted on said web producing machine.

10. The apparatus of claim 8 wherein each of said one or more porous metal plates have a profile that matches the profile of said web at said predetermined location where said apparatus is to be mounted on said web producing machine.

11. The apparatus of claim 8 wherein each of said one or more porous metal plates are rectangular in shape.

12. The apparatus of claim 8 wherein each of said one or more porous metal plates are cut into a contour along the cross direction of a web producing machine on which said apparatus is mounted according to a measured profile of a selected controlling property of said web at said predetermined mounting location.

13. The apparatus of claim 8 further comprising an actuator valve connected between said housing fluid inlet and a source of fluid.

14. The apparatus of claim 13 further comprising a fluid inlet connected between said actuator valve and said fluid source when said apparatus is mounted on said web producing machine.

15. A steam shower for use with a machine that produces a web comprising:

two or more steam housings, each of said two or more steam housings separated from an adjacent one of said two or more housings and having a steam inlet; and one or more porous metal plates mounted in each of said two or more steam housings in an orientation to face said web when said steam shower is mounted at a predetermined location on said web producing machine, each of said porous metal plates being formed from metal powder that is sintered such that each of said porous metal plates comprises micro orifices.

16. The steam shower of claim 15 wherein said porous metal plates are oriented to be parallel to said web when said steam shower is mounted on said web producing machine.

17. The steam shower of claim 15 wherein each of said porous metal plates have a profile that matches the profile of said web at said predetermined location where said steam shower is to be mounted on said web producing machine.

18. The steam shower of claim 15 wherein each of said porous metal plates are rectangular in shape.

19. The steam shower of claim 15 further comprising two or more actuator valves connected between said two or more housings steam inlets, respectively, and a source of steam.

20. The steam shower of claim 19 further comprising two or more steam inlets connected between said two or more actuator valve, respectively, and said steam source when said steam shower is mounted on said web producing machine.

21. In combination:

a machine for producing a web; and one or more fluid distributors each mounted at an associated one of one or more predetermined locations along said web producing machine, each of said one or more fluid distributors comprising:

a fluid housing having a fluid inlet; and one or more porous metal plates mounted in said fluid housing in an orientation to face said web when each of said one or more fluid distributors is mounted at said associated one of said one or more predetermined locations, each of said one or more porous metal plates being formed from metal powder that is sintered such that each of said one or more porous metal plates comprises micro orifices.

22. The combination of claim 21 wherein said fluid is steam.

23. The combination of claim 21 wherein said fluid is air.

24. In combination:

a machine for producing a web; and one or more steam showers each mounted at an associated one of one or more predetermined locations along said web producing machine, each of said one or more steam showers comprising:

two or more steam housings, each of said two or more steam housings being separated from an adjacent one of said two or more housings and having a steam inlet; and one or more porous metal plates mounted in each of said two or more steam housings in an orientation to face said web when each of said one or more steam showers is mounted at said associated one of said one or more predetermined locations, each of said porous metal plates being formed from metal powder that is sintered such that each of said porous metal plates comprises micro orifices.

* * * * *